US012385497B1

(12) United States Patent
Liu et al.

(10) Patent No.: US 12,385,497 B1
(45) Date of Patent: Aug. 12, 2025

(54) FAN BLADE INSTALLATION MECHANISM

(71) Applicant: AIR COOL INDUSTRIAL CO., LTD., Taichung (TW)

(72) Inventors: Tim Liu, Taichung (TW); Noah Fox Vrazel, Atlanta, GA (US)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 19/021,053

(22) Filed: Jan. 14, 2025

(51) Int. Cl.
*F04D 25/08* (2006.01)
*F04D 29/34* (2006.01)

(52) U.S. Cl.
CPC ..... *F04D 29/34* (2013.01); *F04D 25/088* (2013.01)

(58) Field of Classification Search
CPC ..... F04D 29/34; F04D 25/088
See application file for complete search history.

(56) References Cited

U.S. PATENT DOCUMENTS

| | | | | |
|---|---|---|---|---|
| 6,059,531 | A * | 5/2000 | Tai | F04D 29/34 416/207 |
| 6,378,824 | B1 * | 4/2002 | Tseng | F04D 29/34 248/220.21 |
| 12,180,973 | B1 * | 12/2024 | Chen | F04D 25/088 |
| 12,203,478 | B1 * | 1/2025 | Guo | F04D 29/34 |
| 12,264,686 | B1 * | 4/2025 | Botkin | F04D 29/34 |
| 2023/0111026 | A1 * | 4/2023 | Wang | F04D 29/34 416/210 R |

* cited by examiner

*Primary Examiner* — Nathaniel E Wiehe
*Assistant Examiner* — Theodore C Ribadeneyra
(74) *Attorney, Agent, or Firm* — Ying-Ting Chen

(57) ABSTRACT

A fan blade installation mechanism includes a slot and an elastic member. The elastic member is fixedly connected to a groove above the slot. The elastic member is elastically moved between the slot and the groove for a blade to be inserted into the slot. A blade hole of the blade is guided and secured by bevels of a protrusion of an elastic portion in the slot and the elastic member. The elastic member has an operation portion. The fan blade installation mechanism has the advantages of rapid installation and removal of blades, stability without wobbling, ease of assembly, high assembly safety, and reducing the tolerance and gap between the blade and the fan blade installation mechanism in the manufacturing process.

9 Claims, 9 Drawing Sheets

FAN BLADE INSTALLATION MECHANISM

FIELD OF THE INVENTION

The present invention relates to a ceiling fan, and more particularly to a fan blade installation mechanism.

BACKGROUND OF THE INVENTION

A conventional ceiling fan blade installation structure comprises a slot, a fan blade, and an elastic locking member. The fan blade has a circular positioning hole. The elastic locking member is located in the slot. An elastic end of the elastic locking member has an arc-shaped protrusion corresponding to the circular positioning hole of the fan blade. The arc-shaped protrusion has a bevel facing outward and corresponding to the fan blade. When the bevel is pushed by the fan blade, the arc-shaped protrusion is elastically displaced, allowing the fan blade to be inserted in the slot. When the fan blade is inserted to an appropriate position, the arc-shaped protrusion is engaged in the circular positioning hole of the fan blade to complete the assembly of the fan blade.

In the foregoing conventional ceiling fan blade installation structure, there is a tolerance and gap between the arc-shaped protrusion of the elastic locking member and the blade hole in the manufacturing process, and there is a large gap between the slot and the fan blade because the elastic locking member is disposed in the slot, which has the disadvantage of being easy to wobble. Accordingly, the inventor of the present invention has devoted himself based on his many years of practical experiences to solve these problems.

SUMMARY OF THE INVENTION

The primary object of the present invention is to provide a fan blade installation mechanism, which has the advantages of rapid installation and removal of blades, good tightness, stability without wobbling, ease of assembly, and high assembly safety.

In order to achieve the above object, the present invention provides a fan blade installation mechanism, applied to a ceiling fan motor and a blade. The ceiling fan motor includes a rotating portion. The blade has a coupling end and a coupling portion. The coupling portion is adjacent to the coupling end. The coupling portion is gradually enlarged from the coupling end in a direction away from the coupling end. The coupling portion of the blade has a blade hole longitudinally passing through the coupling portion. The blade hole is a polygonal hole. A bottom of the blade hole has a plurality of bottom edges. The coupling portion further has a fastening portion between the blade hole and the coupling end. The fan blade installation mechanism comprises an upper part, a lower part, and an elastic member. One of the upper part and the lower part is fixedly connected to the rotating portion. The upper part is fixedly connected to the lower part to form a slot between the upper part and the lower part. The slot forms a slot space therein. The slot space has a height corresponding to a thickness of the blade. A front opening is formed on an outer side of the slot for insertion of the coupling portion of the blade, so that the blade can be moved along a displacement path within the slot space. The upper part is fixed to an underside of the rotating portion of the ceiling fan motor. One side of the upper part, adjacent to the slot space, is recessed upward to form a groove. The groove communicates with the slot space. The groove is formed with at least one screw hole. The lower part is fixed to an underside the upper part. The lower part has a blocking wall corresponding to the coupling portion of the blade. The lower part further has an elastic portion. One end of the elastic portion is connected to the lower part. Another end of the elastic portion is adjacent to the slot space and has a protrusion corresponding to the blade hole. The protrusion has a plurality of bevels corresponding to the bottom edges of the blade hole. The bevels each slope outwardly from top to bottom. The protrusion is gradually enlarged from top to bottom, allowing the protrusion to lean against the bottom edges of the blade hole. Two of the bevels are defined as a front bevel and a rear bevel. The front bevel corresponds to the front opening and the coupling end of the blade. A rear opening is formed between the upper part and the lower part opposite the front opening. The elastic member has a closed end and a free end. The closed end of the elastic member is formed with at least one through hole. At least one screw passes through the through hole of the closed end of the elastic member and is screwed to the screw hole of the groove of the upper part. The closed end of the elastic member is fixedly connected to the groove of the upper part through at least one screw. The at least one screw is not beyond the groove. The free end of the elastic member extends toward the slot space and the displacement path. The free end of the elastic member has a pushing portion, a first blocking portion, a second blocking portion, and an operating portion. The pushing portion corresponds to the front opening of the slot and the coupling end of the blade. The pushing portion slopes downwardly a direction away from the front opening. The first blocking portion extends upwardly from one end of the pushing portion opposite the front opening. The second blocking portion extends transversely from the first blocking portion in the direction away from the front opening. The first blocking portion and the second blocking portion correspond to the fastening portion of the blade. The operating portion extends outwardly from the second blocking portion toward the rear opening.

In a normal state, the pushing portion and the first blocking portion of the elastic member and the protrusion of the elastic portion of the lower part are located in the displacement path. When the coupling end and the coupling portion of the blade apply force to the pushing portion of the elastic member and the front bevel of the protrusion of the lower part, the protrusion of the elastic portion of the lower part is elastically moved away from the displacement path, and the pushing portion, the first blocking portion and the second blocking portion of the elastic member are elastically moved toward the groove and away from the displacement path. When the coupling portion of the blade is fully inserted into the slot, the blocking wall of the lower part engages the coupling portion of the blade, the slot restricts longitudinal displacement of the coupling portion of the blade, and the elastic member and the protrusion of the elastic portion of the lower part are elastically displaced to a position in the normal state, so that the first blocking portion and the second blocking portion of the elastic member and the blocking wall of the lower part and the rear bevel of the protrusion of the lower part guide and secure the tightening portion of the blade. The rear bevel leans against a corresponding one of the bottom edges of the blade hole, so that the coupling portion of the blade is tightly against the blocking wall of the lower part for restricting longitudinal, transverse and circumferential displacement of the coupling portion of the blade to complete installation of the blade. When a user applies force to the operating portion in an upward direction, the pushing portion, the first blocking portion and the second blocking portion of the elastic member are elastically moved toward the groove and away from the displacement path for the user to remove the blade.

The fan blade installation mechanism provided by the present invention has the advantages of rapid installation and removal of blades, stability without wobbling, and reducing the tolerance and gap between the blade and the fan blade installation mechanism in the manufacturing process. Through the configuration of the operating portion, the user can work underneath the blade, thereby enhancing the convenience and safety of assembling the blade.

DETAILED DESCRIPTION OF THE PREFERRED EMBODIMENTS

Figure 1:
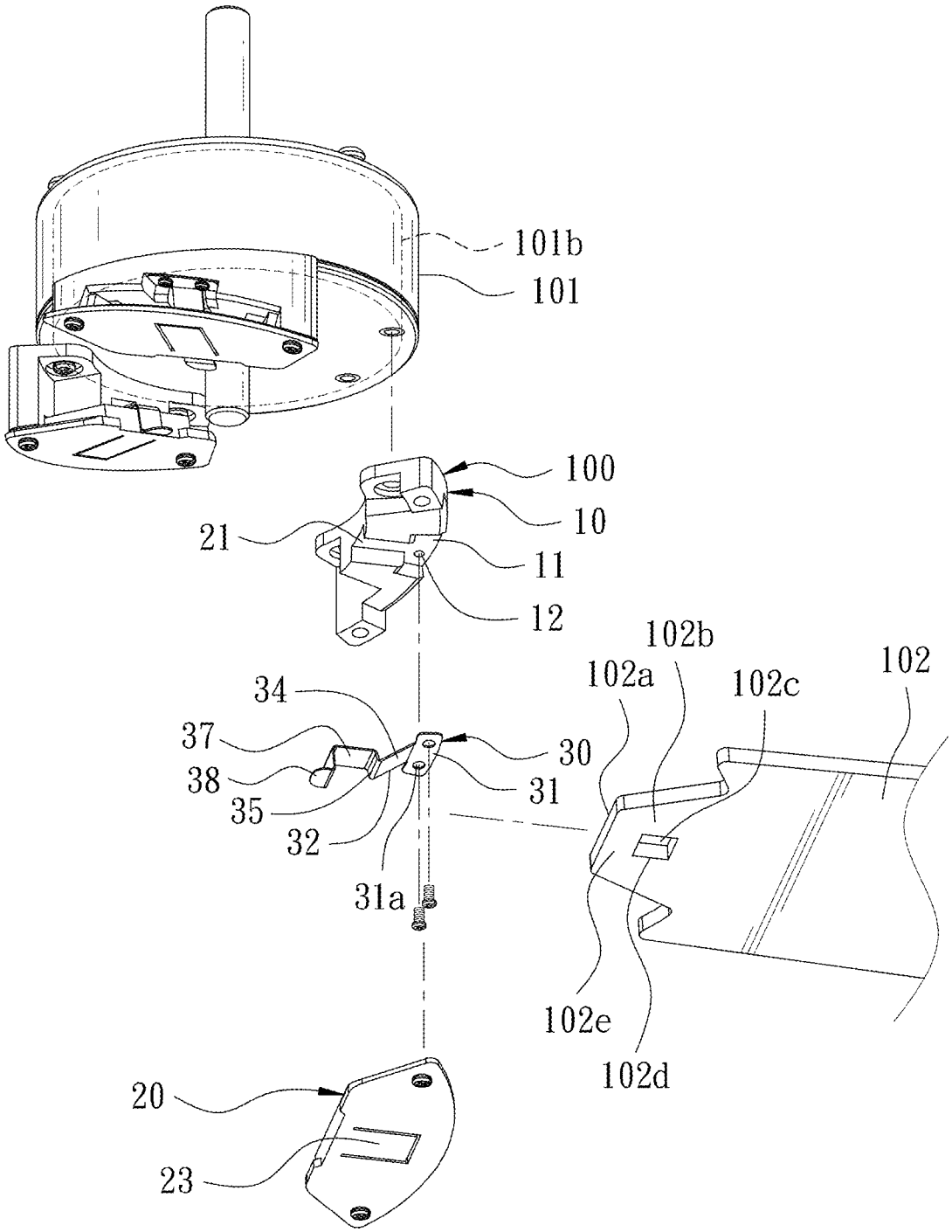
FIG. 1 is an exploded view according to a preferred embodiment of the present invention.
Figure 2:
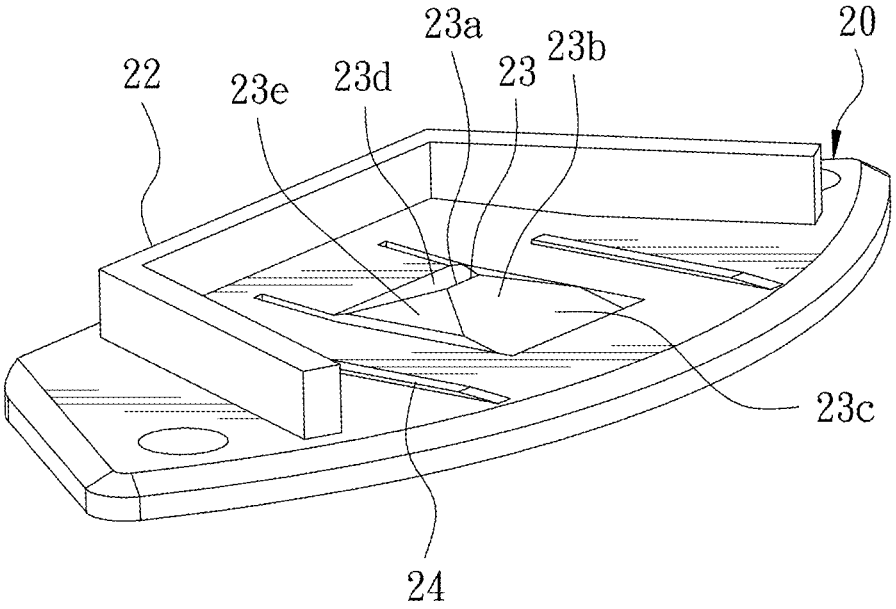
FIG. 2 is a perspective view of the lower part according to the preferred embodiment of the present invention.
Figure 3:
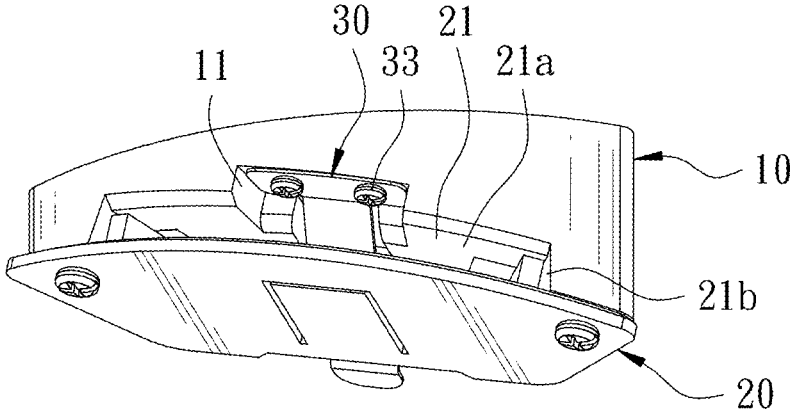
FIG. 3 is a schematic view according to the preferred embodiment of the present invention when in use, illustrating the assembly of the upper part, the lower part and the elastic member.

Embodiments of the present invention will now be described, by way of example only, with reference to the accompanying drawings.

As shown in FIG. 1 through FIG. 9, the present invention discloses a fan blade installation mechanism 100, applied to a ceiling fan motor 101 and a blade 102. The ceiling fan motor 101 is an external rotor motor. The ceiling fan motor 101 includes a rotor 101*a* and a rotating portion 101*b*. The rotor 101*a* drives the rotating portion 101*b* to rotate. The blade 102 has a coupling end 102*a* and a coupling portion 102*b*. The coupling portion 102*b* is adjacent to the coupling end 102*a*. The coupling portion 102*b* is gradually enlarged from the coupling end 102*a* in a direction away from the coupling end 102*a*. The coupling portion 102*b* of the blade 102 has a blade hole 102*c* longitudinally passing through the coupling portion 102*b*. The blade hole 102*c* is a polygonal hole. In this embodiment, the blade hole 102*c* is a square hole. The bottom of the blade hole 102*c* has a plurality of bottom edges 102*d*. The coupling portion 102*b* further has a fastening portion 102*e* between the blade hole 102*c* and the coupling end 102*a*. The fan blade installation mechanism 100 includes an upper part 10, a lower part 20, and an elastic member 30. One of the upper part 10 and the lower part 20 is fixedly connected to the rotating portion 101*b*. The upper part 10 is fixedly connected to the lower part 20 to form a slot 21 between the upper part 10 and the lower part 20. The slot 21 forms a slot space 21*a* therein. The height of the slot space 21*a* corresponds to the thickness of the blade 102. A front opening 21*b* is formed on the outer side of the slot 21 for insertion of the coupling portion 102*b* of the blade 102, so that the blade 102 can be moved along a displacement path 21*c* within the slot space 21*a*.

The upper part 10 is fixed to the underside of the rotating portion 101*b* of the ceiling fan motor 101. One side of the upper part 10, adjacent to the slot space 21*a*, is recessed upward to form a groove 11. The groove 11 communicates with the slot space 21*a*. The groove 11 is formed with at least one screw hole 12.

The lower part 20 is fixed to the underside the upper part 10. The lower part 20 has a longitudinal blocking wall 22 corresponding to the coupling portion 102*b* of the blade 102. The lower part 20 further has an elastic portion 23. The elastic portion 23 is located at a middle position of the lower part 20. One end of the elastic portion 23 is connected to the lower part 20. The elastic portion 23 is integrally formed with the lower part 20. The other end of the elastic portion 23 is adjacent to the slot space 21*a* and has a protrusion 23*a* corresponding to the blade hole 102*c*. The protrusion 23*a* has a plurality of bevels 23*b* corresponding to the bottom edges 102*d* of the blade hole 102*c*. The bevels 23*b* each slope outwardly from top to bottom. The protrusion 23*a* is gradually enlarged from top to bottom, allowing the protrusion 23*a* to lean against the bottom edges 102*d* of the blade hole 102*c*. At least one of the bevels 23*b* leans against a corresponding one of the bottom edges 102*d* of the blade hole 102*c*. Two of the bevels 23*b* are defined as a front bevel 23*c* and a rear bevel 23*d*. The front bevel 23*c* corresponds to the front opening 21*b* and the coupling end 102*a* of the blade 102. The bevels 23*b* further define a plurality of side bevels 23*e*. The rear bevel 23*d* and the side bevels 23*e* lean against the corresponding bottom edges 102*d* of the blade hole 102*c*. A rear opening 21*d* is formed between the upper part 10 and the lower part 20 opposite the front opening 21*b*. The groove 11 of the upper part 10 communicates with the rear opening 21*d*.

Furthermore, one side of the lower part 20, adjacent to the slot space 21*a*, has two protruding ribs 24 corresponding to the underside of the coupling portion 102*b* of the blade 102. The protruding ribs 24 are spaced apart from each other and located at two sides of the protrusion 23*a* of the elastic portion 23 for reducing friction when the coupling portion 102*b* of the blade 102 is inserted into the slot 21.

The elastic member 30 has a closed end 31 and a free end 32. The closed end 31 of the elastic member 30 is formed with at least one through hole 31*a*. The width of the elastic member 30 corresponds to the width of the groove 11. At least one screw 33 passes through the through hole 31*a* of the closed end 31 of the elastic member 30 and is screwed to the screw hole 12 of the groove 11 of the upper part 10. The at least one screw 33 is not beyond the groove 11. The free end 32 of the elastic member 30 extends toward the slot space 21*a* and the displacement path 21*c*. The free end 32 of the elastic member 30 has a pushing portion 34, a first blocking portion 35, a second blocking portion 37, and an operating portion 38. The pushing portion 34 corresponds to the front opening 21*b* of the slot 21 and the coupling end 102*a* of the blade 102. The pushing portion 34 slopes downwardly in a direction away from the front opening 21*b*. The first blocking portion 35 extends upwardly from one end of the pushing portion 34 opposite the front opening 21*b*. An included angle 36 is defined between the pushing portion 34 and the first blocking portion 35 of the elastic member 30 to enhance the structural strength of the first blocking portion. The second blocking portion 37 extends transversely from the first blocking portion 35 in a direction away from the front opening 21*b*. The first blocking portion 35 and the second blocking portion 37 correspond to the fastening portion 102*e* of the blade 102. The operating portion 38 extends outwardly from the second blocking portion 37 toward the rear opening 21*d*. The rear bevel 23*d* of the protrusion 23*a* of the lower part 20 corresponds to the first blocking portion 35.

Figure 4:
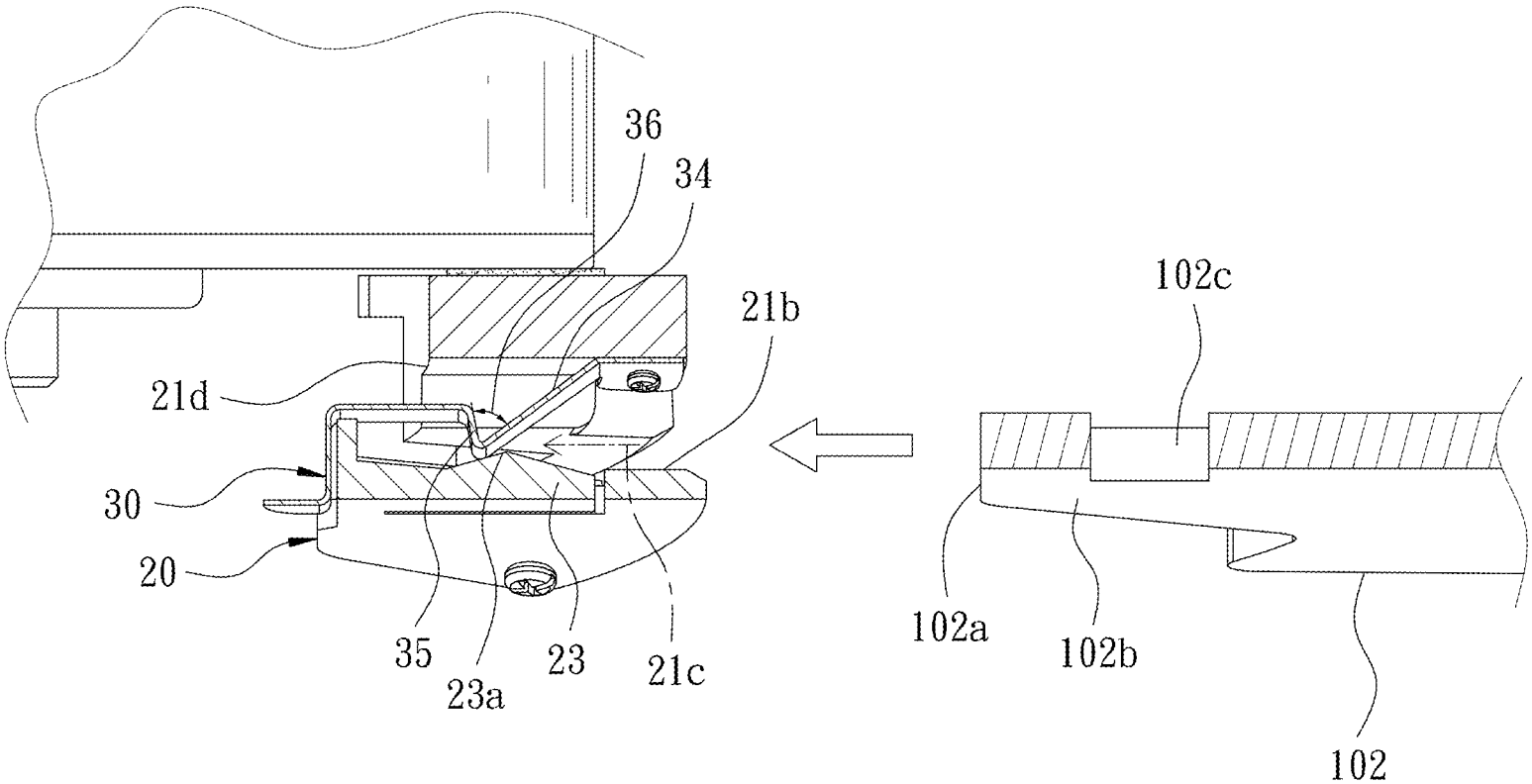
FIG. 4 is a schematic view according to the preferred embodiment of the present invention when in use, illustrating that the blade is not inserted into the slot.

Referring to FIG. 4, in a normal state, the pushing portion 34 and the first blocking portion 35 of the elastic member 30 and the protrusion 23*a* of the elastic portion 23 of the lower part 20 are located in the displacement path 21 *c*.

Figure 5:
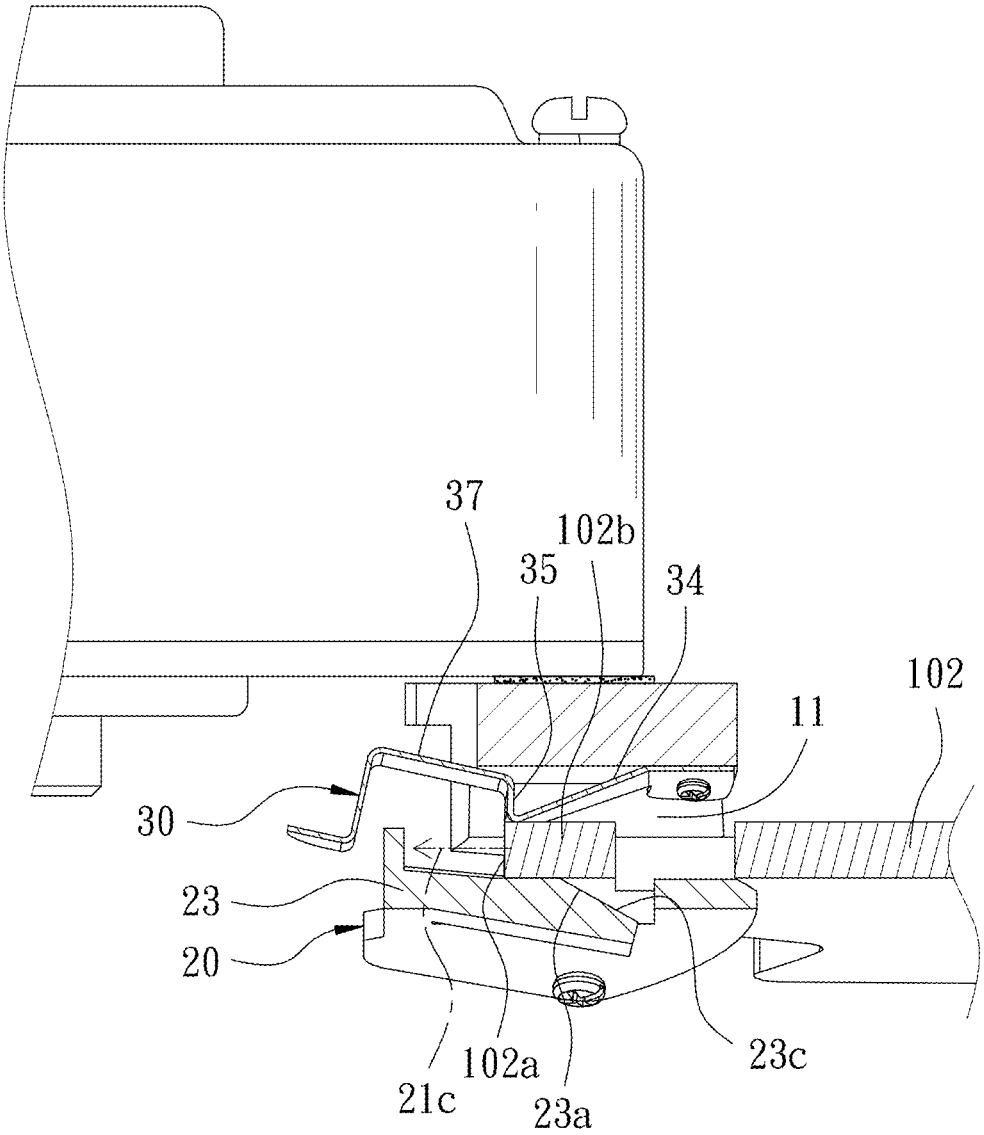
FIG. 5 is a schematic view according to the preferred embodiment of the present invention when in use, illustrating that the blade applies force to the elastic member.

Referring to FIG. 5, when the coupling end 102*a* and the coupling portion 102*b* of the blade 102 apply force to the pushing portion 34 of the elastic member 30 and the front bevel 23*c* of the protrusion 23*a* of the lower part 20, the protrusion 23*a* of the elastic portion 23 of the lower part 20 is elastically moved away from the displacement path 21*c*, and the pushing portion 34, the first blocking portion 35 and the second blocking portion 37 of the elastic member 30 are elastically moved toward the groove 11 and away from the displacement path 21.

Figure 6:
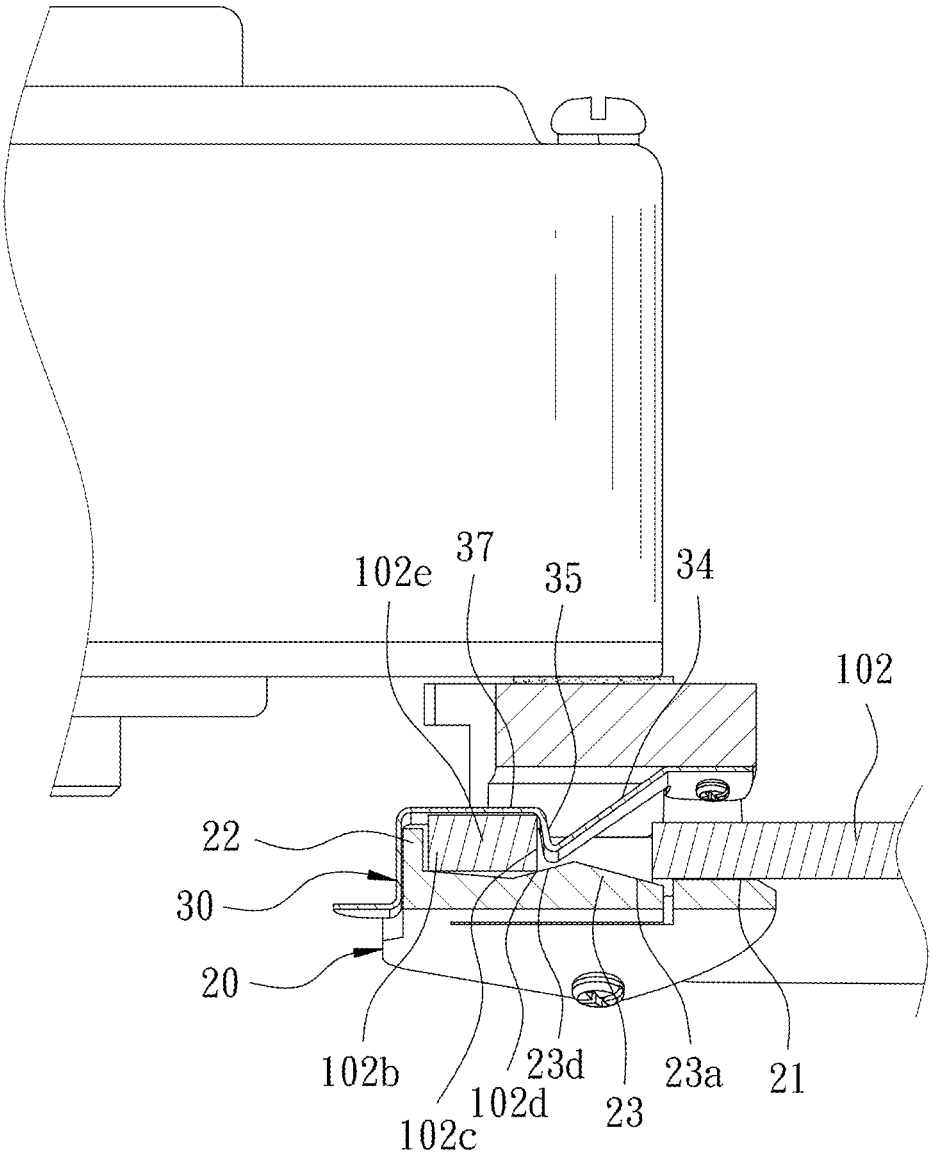
FIG. 6 is a schematic view according to the preferred embodiment of the present invention when in use, illustrating that the coupling portion of the blade is fully inserted into the slot.
Figure 7:
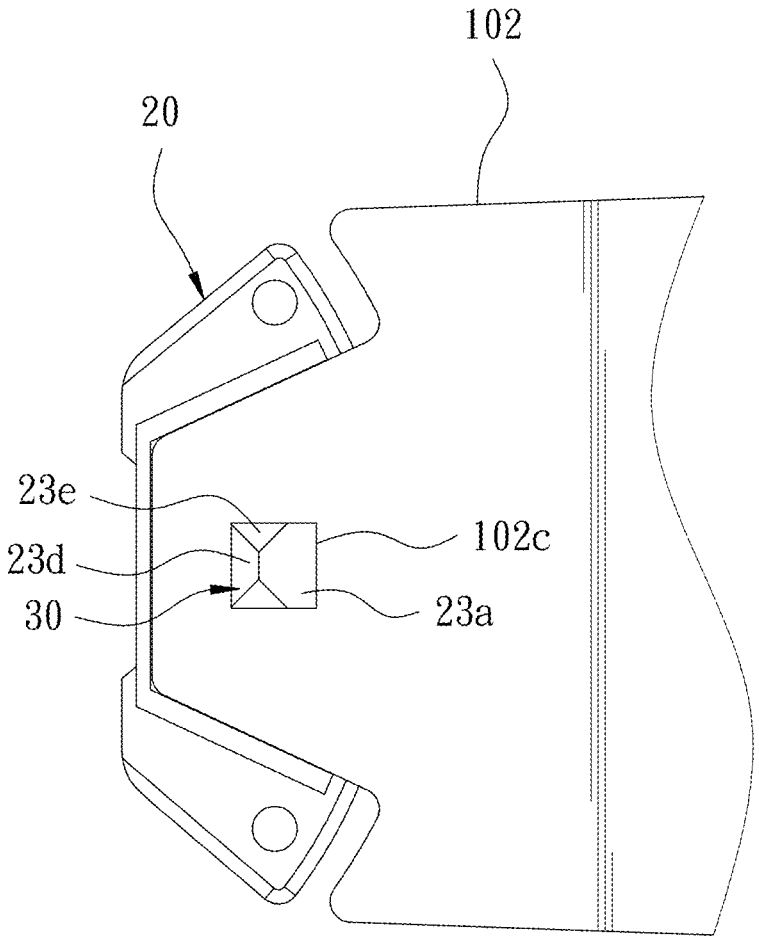
FIG. 7 is a schematic view according to the preferred embodiment of the present invention when in use, illustrating the configuration of the blade hole, the rear bevel and the side bevels when the coupling portion of the blade is fully inserted into the slot.

Referring to FIG. 6, when the coupling portion 102*b* of the blade 102 is fully inserted into the slot 21, the blocking wall 22 of the lower part 20 engages the coupling portion 102*b* of the blade 102. The slot 21 restricts the longitudinal displacement of the coupling portion 102*b* of the blade 102. The elastic member 30 and the protrusion 23*a* of the elastic portion 23 of the lower part 20 are elastically displaced to the position in the normal state, so that the first blocking portion 35 and the second blocking portion 37 of the elastic member 30 and the blocking wall 22 of the lower part 20 and the rear bevel 23*d* of the protrusion 23*a* of the lower part 20 guide and secure the tightening portion 102*e* of the blade 102. The protrusion 23*a* of the elastic portion 23 of the lower part 20 has the feature that it is gradually enlarged from top to bottom. The rear bevel 23*d* leans against the corresponding bottom edge 102*d* of the blade hole 102*c*, so that the coupling portion 102*b* of the blade 102 is tightly against the blocking wall 22 of the lower part 20 for restricting the longitudinal, transverse and circumferential displacement of the coupling portion 102*b* of the blade 102 to complete the installation of the blade 102, thereby reducing the tolerance and gap between the coupling portion 102*b* of the blade and the slot 21 in the manufacturing process and improving the wobbling of the blade.

Referring to FIG. 1, FIG. 2, FIG. 6 and FIG. 7, within a certain tolerance range of the blade hole 102*c*, the rear bevel 23*d* and the side bevels 23*e* lean against the corresponding bottom edges 102*d* of the blade hole 102*c* effectively, thereby reducing the tolerance and gap between the blade hole 102*c* and the protrusion 23*a* of the elastic member 30 in the manufacturing process and improving the wobbling of the blade.

Figure 8:
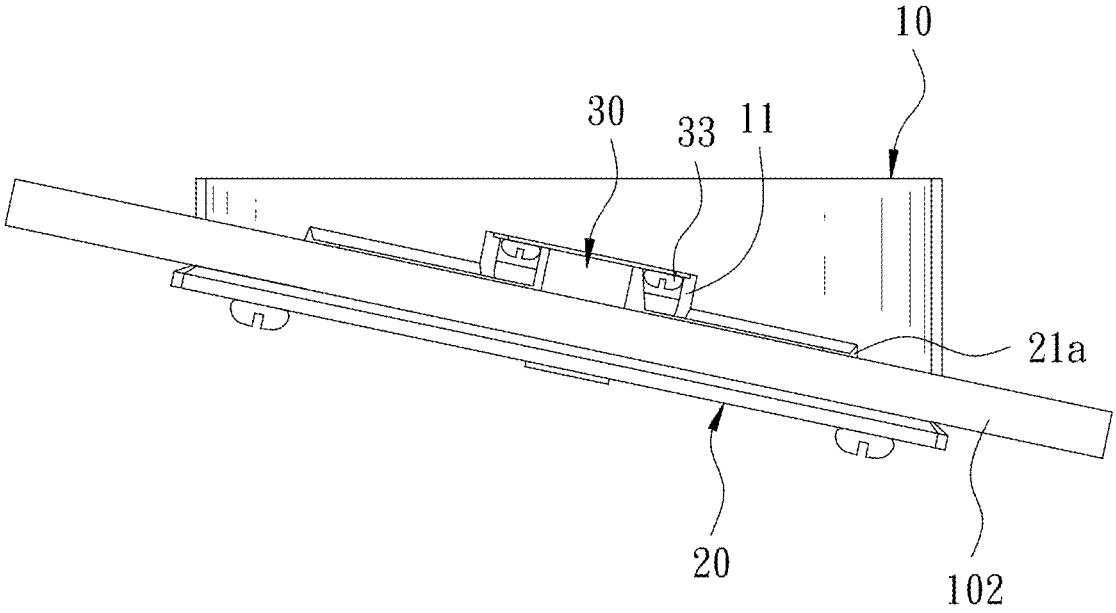
FIG. 8 is a schematic view according to the preferred embodiment of the present invention when in use, illustrating the configuration of the groove and the screw when the coupling portion of the blade is fully inserted into the slot.

Referring to FIG. 8, the height of the slot space 21*a* corresponds to the thickness of the blade 102. One side of the upper part 10, adjacent to the slot space 21*a*, is recessed upward to form the groove 11. The screw 33 used in the elastic member 30 is not beyond the groove 11, so that the gap among the upper part 10, the lower part 20 and the blade 102 is extremely small. When the ceiling fan is rotating, it is less likely to cause the blade 102 to wobble.

Figure 9:
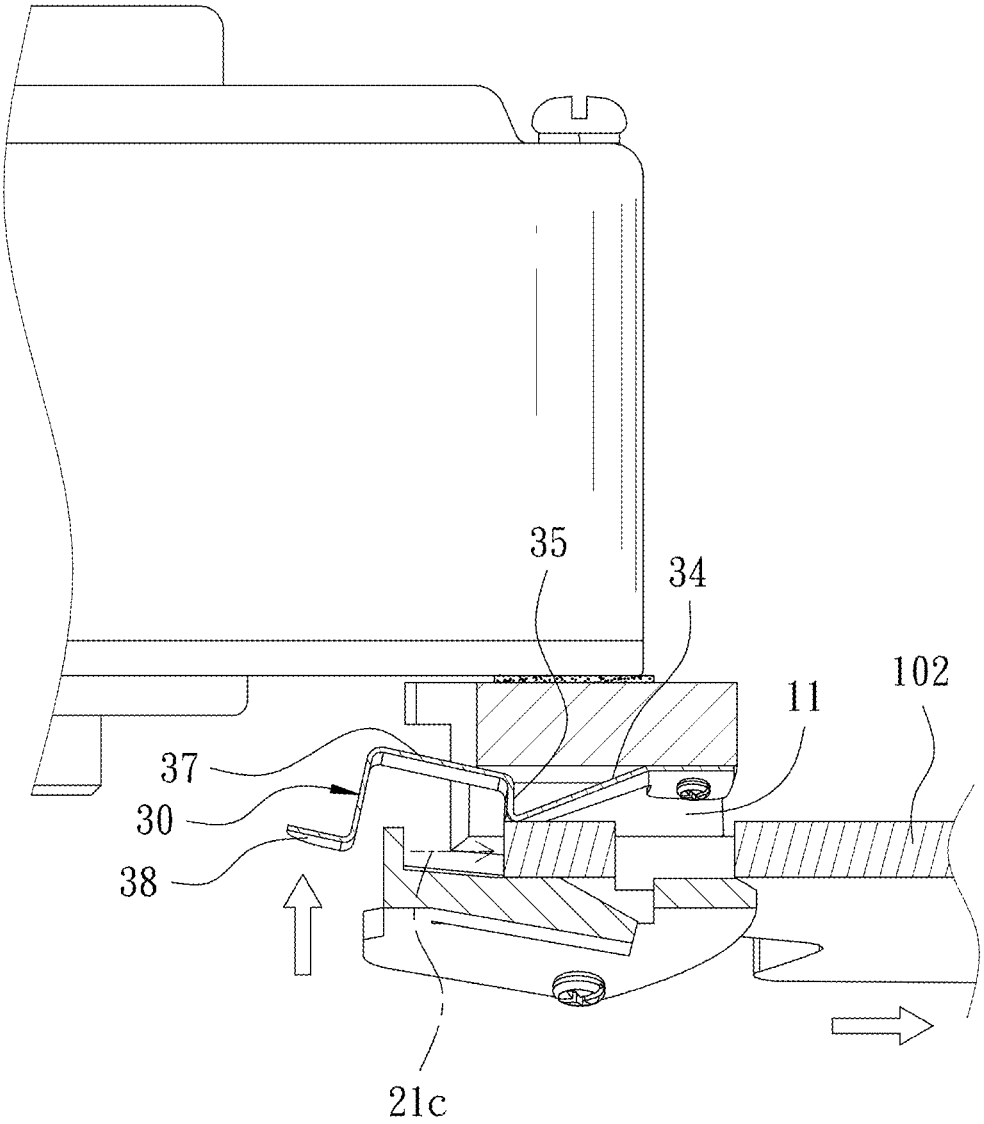
FIG. 9 is a schematic view according to the preferred embodiment of the present invention when in use, illustrating that the user applies force to the operating portion to remove the blade.

Referring to FIG. 9, when the user applies force to the operating portion 38 in an upward direction, the pushing portion 34, the first blocking portion 35 and the second blocking portion 37 of the elastic member 30 are elastically moved toward the groove 11 and away from the displacement path 21*c* for the user to remove the blade 102.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A fan blade installation mechanism, applied to a ceiling fan motor and a blade, the ceiling fan motor including a rotating portion, the blade having a coupling end and a coupling portion, the coupling portion being adjacent to the coupling end, the coupling portion being gradually enlarged from the coupling end in a direction away from the coupling end, the coupling portion of the blade having a blade hole longitudinally passing through the coupling portion, the blade hole being a polygonal hole, a bottom of the blade hole having a plurality of bottom edges, the coupling portion further having a fastening portion between the blade hole and the coupling end, the fan blade installation mechanism comprising an upper part, a lower part and an elastic member, one of the upper part and the lower part being fixedly connected to the rotating portion, the upper part being fixedly connected to the lower part to form a slot between the upper part and the lower part, the slot forming a slot space therein, the slot space having a height corresponding to a thickness of the blade, a front opening being formed on an outer side of the slot for insertion of the coupling portion of the blade so that the blade can be moved along a displacement path within the slot space, characterized in that:

the upper part is fixed to an underside of the rotating portion of the ceiling fan motor, one side of the upper part, adjacent to the slot space, is recessed upward to form a groove, the groove communicates with the slot space, the groove is formed with at least one screw hole;

the lower part is fixed to an underside of the upper part, the lower part has a blocking wall corresponding to the coupling portion of the blade, the lower part further has an elastic portion, one end of the elastic portion is connected to the lower part, another end of the elastic portion is adjacent to the slot space and has a protrusion corresponding to the blade hole, the protrusion has a plurality of bevels corresponding to the bottom edges of the blade hole, the bevels each slope outwardly from top to bottom, the protrusion is gradually enlarged from top to bottom, allowing the protrusion to lean against the bottom edges of the blade hole, two of the bevels are defined as a front bevel and a rear bevel, the front bevel corresponds to the front opening and the coupling end of the blade, a rear opening is formed between the upper part and the lower part opposite the front opening;

the elastic member has a closed end and a free end, the closed end of the elastic member is formed with at least one through hole, at least one screw passes through the through hole of the closed end of the elastic member and is screwed to the screw hole of the groove of the upper part, the at least one screw is not beyond the groove, the free end of the elastic member extends toward the slot space and the displacement path, the free end of the elastic member has a pushing portion, a first blocking portion, a second blocking portion and an operating portion, the pushing portion corresponds to the front opening of the slot and the coupling end of the blade, the pushing portion slopes downwardly in a direction away from the front opening, the first blocking portion extends upwardly from one end of the pushing portion opposite the front opening, the second blocking portion extends transversely from the first blocking portion in the direction away from the front opening, the first blocking portion and the second blocking portion correspond to the fastening portion of the blade, the operating portion extends outwardly from the second blocking portion toward the rear opening;

wherein, in a normal state, the pushing portion and the first blocking portion of the elastic member and the protrusion of the elastic portion of the lower part are located in the displacement path;

wherein when the coupling end and the coupling portion of the blade apply force to the pushing portion of the elastic member and the front bevel of the protrusion of the lower part, the protrusion of the elastic portion of the lower part is elastically moved away from the displacement path, and the pushing portion, the first blocking portion and the second blocking portion of the elastic member are elastically moved toward the groove and away from the displacement path;

wherein when the coupling portion of the blade is fully inserted into the slot, the blocking wall of the lower part engages the coupling portion of the blade, the slot restricts longitudinal displacement of the coupling portion of the blade, and the elastic member and the protrusion of the elastic portion of the lower part are elastically displaced to a position in the normal state so that the first blocking portion and the second blocking portion of the elastic member and the blocking wall of the lower part and the rear bevel of the protrusion of the lower part guide and secure a tightening portion of the blade, wherein the rear bevel leans against a corresponding one of the bottom edges of the blade hole so that the coupling portion of the blade is tightly against the blocking wall of the lower part for restricting longitudinal, transverse and circumferential displacement of the coupling portion of the blade to complete installation of the blade;

wherein when a user applies force to the operating portion in an upward direction, the pushing portion, the first blocking portion and the second blocking portion of the elastic member are elastically moved toward the groove and away from the displacement path for the user to remove the blade.

2. The fan blade installation mechanism as claimed in claim 1, wherein the groove of the upper part communicates with the rear opening.

3. The fan blade installation mechanism as claimed in claim 1, wherein the rear bevel of the protrusion of the lower part corresponds to the first blocking portion.

4. The fan blade installation mechanism as claimed in claim 1, wherein one side of the lower part, adjacent to the slot space, has two protruding ribs corresponding to an underside of the coupling portion of the blade, and the protruding ribs are spaced apart from each other and located at two sides of the protrusion of the elastic portion.

5. The fan blade installation mechanism as claimed in claim 1, wherein at least one of the bevels leans against a corresponding one of the bottom edges of the blade hole.

6. The fan blade installation mechanism as claimed in claim 5, wherein the bevels further define a plurality of side bevels, and the rear bevel and the side bevels lean against the corresponding bottom edges of the blade hole.

7. The fan blade installation mechanism as claimed in claim 1, wherein the elastic portion is located at a middle position of the lower part, and the elastic portion is integrally formed with the lower part.

8. The fan blade installation mechanism as claimed in claim 1, wherein the elastic member has a width corresponding to that of the groove.

9. The fan blade installation mechanism as claimed in claim 1, wherein an included angle is defined between the pushing portion and the first blocking portion of the elastic member.

* * * * *